US006389992B1

(12) United States Patent
Miller

(10) Patent No.: US 6,389,992 B1
(45) Date of Patent: May 21, 2002

(54) COMPUTER WORKSTATION

(76) Inventor: Jason L. Miller, 7288 TR 664, Dundee, OH (US) 44687

( * ) Notice: Subject to any disclaimer, the term of this patent is extended or adjusted under 35 U.S.C. 154(b) by 0 days.

(21) Appl. No.: 09/533,253

(22) Filed: Mar. 23, 2000

(51) Int. Cl.[7] ..... A47B 11/00
(52) U.S. Cl. ..... 108/102; 108/59
(58) Field of Search ..... 108/50.41, 92, 108/94, 95, 102, 104, 105, 5, 1, 141, 59, 10, 147

(56) References Cited

U.S. PATENT DOCUMENTS

| | | | | | |
|---|---|---|---|---|---|
| 1,218,923 | A | * | 3/1917 | Bogdanski | 108/5 |
| D140,524 | S | | 3/1945 | Taylor | |
| D207,262 | S | | 3/1967 | Maurer et al. | |
| 3,435,783 | A | | 4/1969 | Kollenborn | |
| D230,383 | S | | 2/1974 | Atkinson | |
| D236,566 | S | | 9/1975 | Parchan | |
| D250,230 | S | | 11/1978 | Kotula | |
| 4,646,655 | A | * | 3/1987 | Robolin | 108/94 |
| 4,932,718 | A | | 6/1990 | Yamazaki | |

FOREIGN PATENT DOCUMENTS

| | | | | |
|---|---|---|---|---|
| AT | 258522 | * | 11/1967 | 108/105 |

* cited by examiner

*Primary Examiner*—Peter M. Cuomo
*Assistant Examiner*—Jerry A. Anderson
(74) *Attorney, Agent, or Firm*—Siemens Patent Services

(57) ABSTRACT

A support structure for establishing a computer workstation around a chair, such as an easy chair or wheelchair. The support structure includes a flat base having a plurality of vertical posts projecting upwardly therefrom. Two of the posts have swing arms terminating in additional swing arms. An inclinably adjustable support platform is disposed above each final swing arm. Either support arm may optionally have a drawer and a clip for retaining papers. The compound swing arms enable the platform to be adjusted to any desired proximity to the post, within a range. The working surfaces of each support platform can be inclined, and the height of each support platform can be adjusted. The support structure has optional auxiliary features including a cup holder, a pencil tray, storage shelves and a filing cabinet, a tabletop having a drawer and a cover panel depending therefrom, for concealing power and communication cables, power cables disposed within the posts, a power supply, an exposed power jack connected to said second power cable, and an auxiliary support for supporting a speaker thereatop. One alternative embodiment includes a motor and a mechanical linkage for adjusting swing arm position.

15 Claims, 7 Drawing Sheets

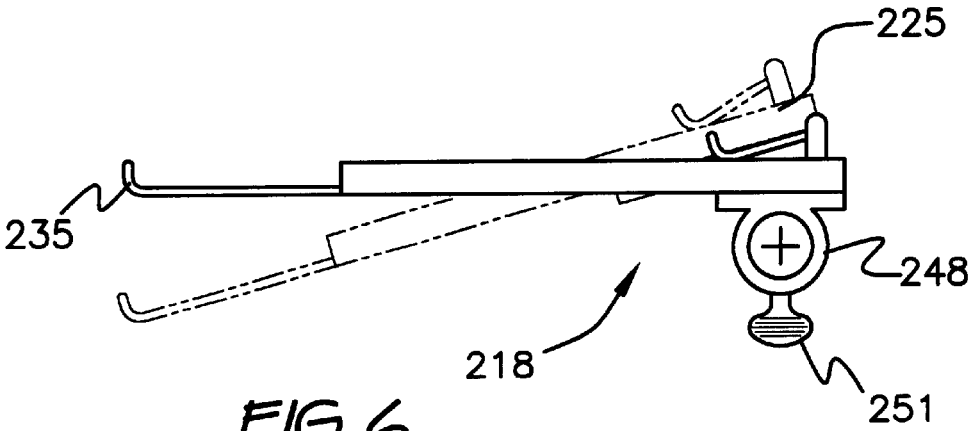
FIG. 6
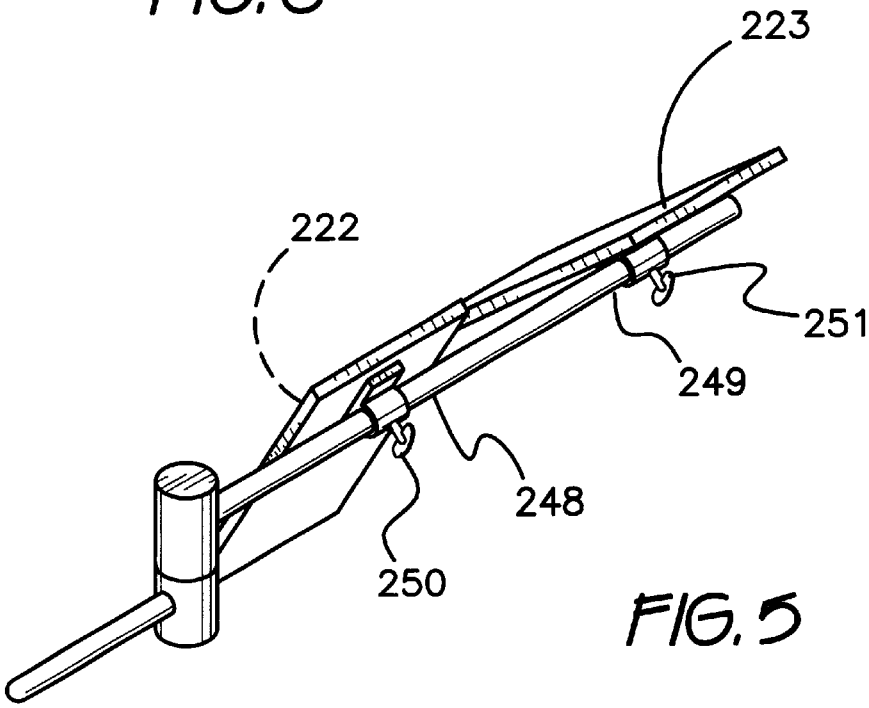
FIG. 5
FIG. 7
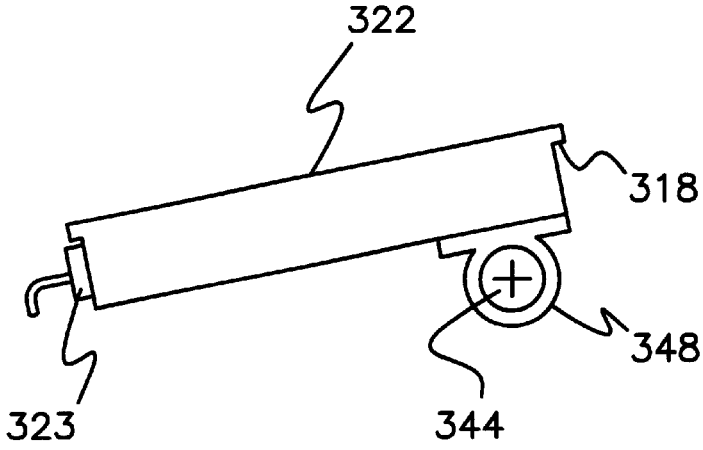

COMPUTER WORKSTATION

BACKGROUND OF THE INVENTION

1. Field of the Invention

The present invention relates to furniture or supporting structure for supporting personal computers and peripheral equipment for use. The structure, combined with a chair for seating a person, creates a stationary yet movable workstation. The invention finds greatest utility in residences and also office, retail, and other utilitarian work places which require that a personal computer be utilized or are intended to have a personal computer operated therein, but which places are not previously configured as workstations. Any general purpose building, including residential, institutional, commercial, and industrial, may be improved to support personal computers by utilizing the present invention.

2. Description of the Prior Art

Personal computers are becoming increasingly integrated into the commercial economy and also utilized by private consumers for their own purposes and also to interface with the commercial economy. Ergonomics and other practical considerations require that computers be placed on a desk or other suitable working environmental furniture or structure. However, chairs provided for use with desks may possibly not be ergonomically suitable for extended periods of computer use. Many people would prefer to adapt large cushioned or padded chairs of the type typically found in the home to computer use. However, most desks and other supporting structure intended for use with personal computers are not dimensioned and configured to cooperate suitably with computers or indeed to accommodate work related surfaces.

The prior art has suggested approaches to adapt chairs to desk work. An example is seen in U.S. Pat. No. 4,932,718, issued to Ryokichi Yamazaki on Jun. 12, 1990, featuring a coupled chair unit. The chair unit has work surfaces which may be selectively swung into a position suitable for writing, and retracted from the operative position. The chair unit of Yamazaki lacks the versatile adjustability of proximity and angle for a work surface and for a separate monitor support surface, as seen in the present invention.

U.S. Pat. No. 3,435,783, issued to Cecil L. Kollenborn on Apr. 1, 1969, shows a tabletop supported on a stand which can be slid into proximity with a chair, for writing and similar tasks. Proximity to the chair is adjusted only by moving the entire stand. By contrast, the present invention enable adjustment without moving the entire device. The present invention further has two independently adjustable work supporting surfaces, rather than the single surface of Kollenborn.

Combined chairs and working surfaces are seen in U.S. Design Pat. No. 140,524, issued to Auburn Taylor on Mar. 6, 1945, U.S. Pat. No. 207,262, issued to Robert A. Maurer et al. on Mar. 28, 1967, U.S. Pat. No. 230,383, issued to Lyle A. Atkinson on Feb. 19, 1974, U.S. Pat. No. 236,566, issued to Warren D. Parchan on Sep. 2, 1975, and U.S. Pat. No. 250,230, issued to Stine Kotula on Nov. 14, 1978. In each case, a working surface supported on an easy chair or the like is provided. However, by contrast, the present invention lacks the chair itself, and has two independent work supporting surfaces adjustably mounted on two spaced apart posts.

None of the above inventions and patents, taken either singly or in combination, is seen to describe the instant invention as claimed.

SUMMARY OF THE INVENTION

The present invention sets forth a support structure which supports a personal computer and related peripherals in the organized manner of a workstation. The support structure positions a computer monitor, keyboard, and mouse, and related apparatus such as printer, adjustably and advantageously around a chair. Because of adjustable positioning, any chairs including lounge and "easy" chairs, and even wheelchairs, may be employed as part of the workstation. The work surfaces, and hence the keyboard and monitor, may be positioned exactly according to a user's wishes. Therefore, the user is afforded both convenience and also comfort wherever a computer workstation is to be established.

The support structure has two work surfaces supported on separate telescoping posts, and a table mounted on a third telescoping post. The first and second posts incorporate swing arms that enable their respective work surfaces to be infinitely adjustable as to proximity to their posts. Height of all of the posts is adjusted by securing telescoping post members at selected heights. One work surface can be inclined to suit.

Auxiliary features include cup holders, drawer, ashtray holder, pen and pencil tray, a drawer for stowing the keyboard and mouse, a speaker stand for accommodating speakers, clips for securing papers to a work surface, additional storage space in the form of a hutch and closed cabinet, wire covers for protecting signal and power cables, and optional power supplies and associated extension cables. In a further option, the swing arms are powered, so that handicapped users can readily adjust proximity of the work surfaces.

Accordingly, it is one object of the invention to provide structure for supporting a personal computer in proximity to a chair not originally designed to cooperate with a computer support.

It is another object of the invention that the support structure be adjustable so that computer components are positioned exactly according to a user's wishes.

It is a further object of the invention to accommodate small personal and work articles on the support structure.

Still another object of the invention is to accommodate the needs of the handicapped in a computer workstation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 5 is a front perspective detail view of an embodiment of a portion of the invention.

FIG. 6 is an end elevational detail view of FIG. 5.

FIG. 7 is an end elevational detail view of an embodiment of a portion of the invention.

DETAILED DESCRIPTION OF THE PREFERRED EMBODIMENTS

Figure 1:
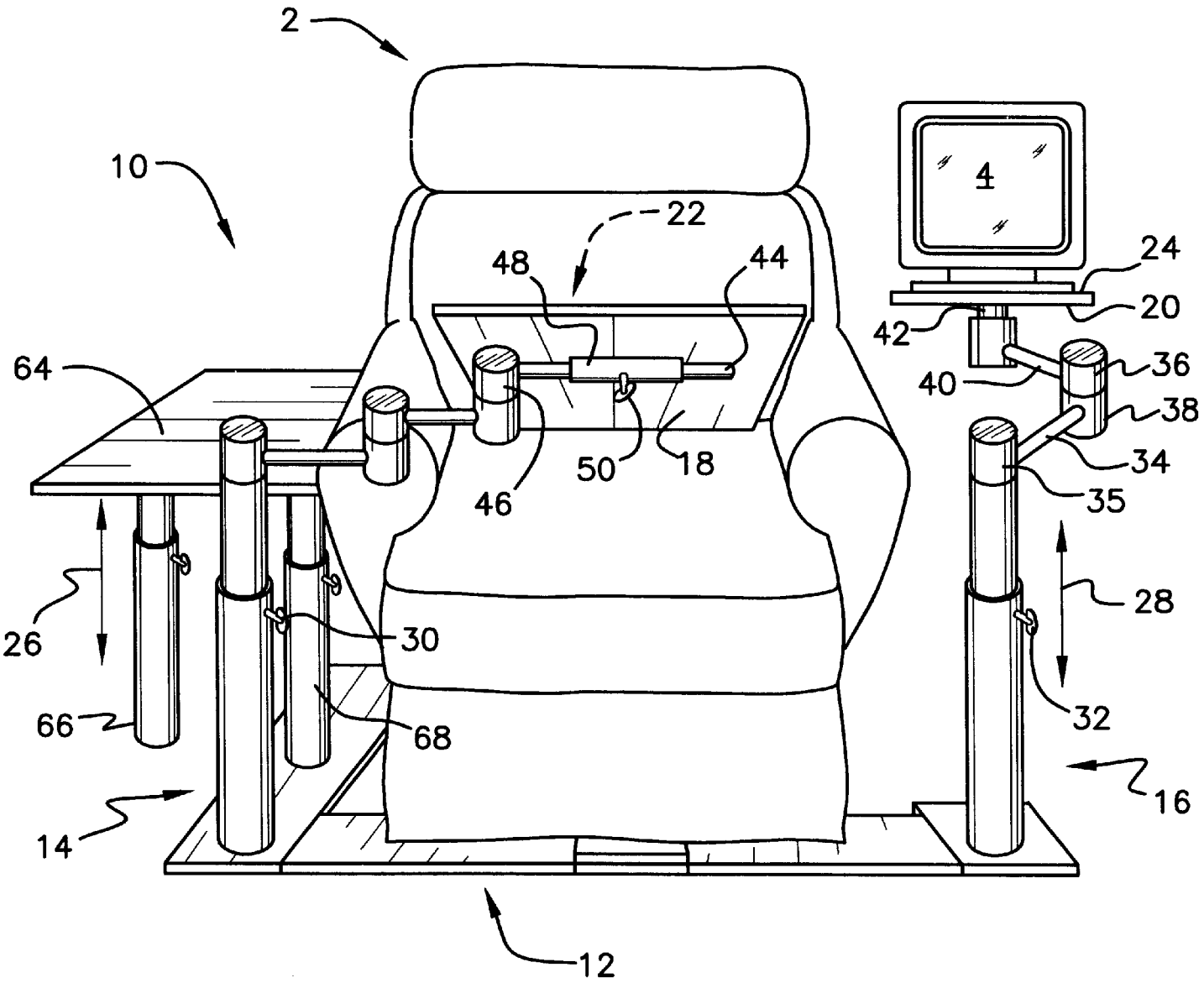
FIG. 1 is an environmental, front perspective view of an embodiment of the overall invention.

FIG. 1 of the drawings shows an embodiment of the invention as it would be erected near an easy chair 2. Chair 2 is representative of any chair, and most advantageously is of a type which is associated with residential use, and is designed primarily for comfort. The invention comprises a support structure 10 for supporting a personal computer (exemplified by monitor 4) and related peripheral equipment such as a keyboard and mouse (not shown) in sufficient proximity to chair 2 as to establish a computer workstation utilizing chair 2. Support structure 10 comprises a flat base 12 having at least two posts 14, 16 attached to and projecting upwardly from base 12. Posts 14, 16 each have a respective panel 18 or 20 having a flat upper work surface 22 or 24 affixed thereto. As illustrated, work surface 24 supports monitor 4. Work surface 22 is advantageously employed to support a keyboard and mouse.

Posts 14, 16 each have means for adjusting both height and also proximity of work surface 22 or 24 relative to their associated posts 14 or 16. Each post 14 or 16 is formed in two telescoping sections such that overall height of the post 14 or 16 may be adjusted in a vertical direction exemplified by arrows 26, 28. Setscrews 30, 32 are tightened to secure the sections of posts 14, 16 in selected axial relationship relative to arrows 26, 28 and also to prevent mutual rotation between the sections.

The upper section of each post 14 or 16 has assemblies associated therewith for adjusting proximity of its respective work surface 22 or 24 relative to the longitudinal axis of its associated post 14 or 16. This arrangement will be described with respect to post 16, it being understood that post 14 is functionally similar. A first swing arm 34 is connected to and projects laterally from a socket 35 rotatably mounted on the upper section of post 16. Swing arm 34 terminates in a socket arrangement wherein a pivotal socket 36 is pivotally supported on a base 38. Socket 36 and base 38 may include, for example, a concealed pin fixed to base 38 about which socket 36 may freely rotate such that a second swing arm 40 swings through a horizontal plane. Second swing arm 40 terminates in a socket arrangement equivalent to that of socket 36. However, socket 42 of swing arm 40 is connected to panel 20.

Sockets 35, 36 are arranged such that swing arm 34 rotates about the longitudinal axis of post 16, and swing arm 38 rotates independently about the longitudinal axis of socket 36. A compound motion is thus enabled which enables panel 20 to be adjusted selectively at any desired proximity to post 16, within a range determined by the combined lengths of swing arms 34, 40. It is intended that panel 20 will be adjusted so that monitor 4 is located at the most convenient location for a user seated in chair 2. It should be noted that setscrew 32 is also utilized to establish an optimum height of platform 24 above base 12. Post 14 may similarly be adjusted so that panel 18 is suitably and conveniently positioned to afford ergonomic proximity of a keyboard and mouse.

Panel 18 and hence work surface 22 may be inclined relative to horizontal orientation in the following way. A support arm 44 projects from socket 46 of post 14. A collar 48 rigidly attached to panel 18 encircles arm 44. Collar 48 and panel 18 can be rotated about the longitudinal axis of arm 44. A setscrew 50 is tightened when work surface 22 is at a selected degree of inclination.

Figure 2:
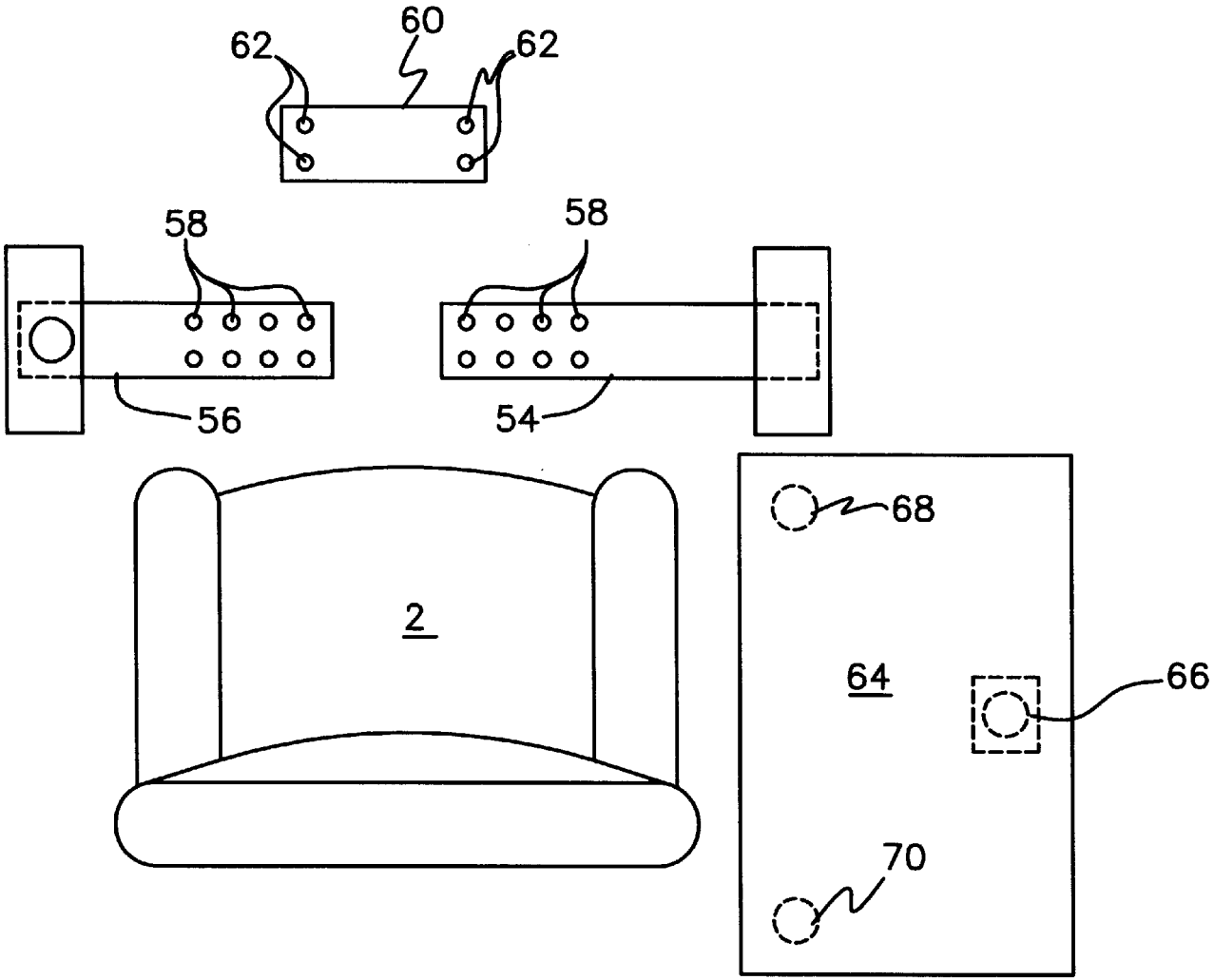
FIG. 2 is an environmental, top plan detail view of FIG. 1, with some components omitted for clarity of the view.

It will be appreciated that chairs are available in many configurations and dimensions. Therefore, it is desirable to enable adjustment of length of base 12, in that length relates to spanning the width of chair 2. When base 12 is adjusted, posts 14, 16 are selectively spaced apart to a desired interval of separation. FIG. 2 shows structure enabling base 12 to be adjusted. Base 12 is formed in right and left sections 54, 56 each bearing a series of spaced apart holes 58. A spanning member 60 has downwardly facing projections 62 which are configured and dimensioned to enter and cooperate closely with holes 58. When sections 54, 56 are spaced apart at a desired interval, member 60 is placed over sections 54, 56 and pressed downwardly until projections 62 enter some of the holes 56, thereby locking sections 54, 56 in the selected position.

Figure 3:
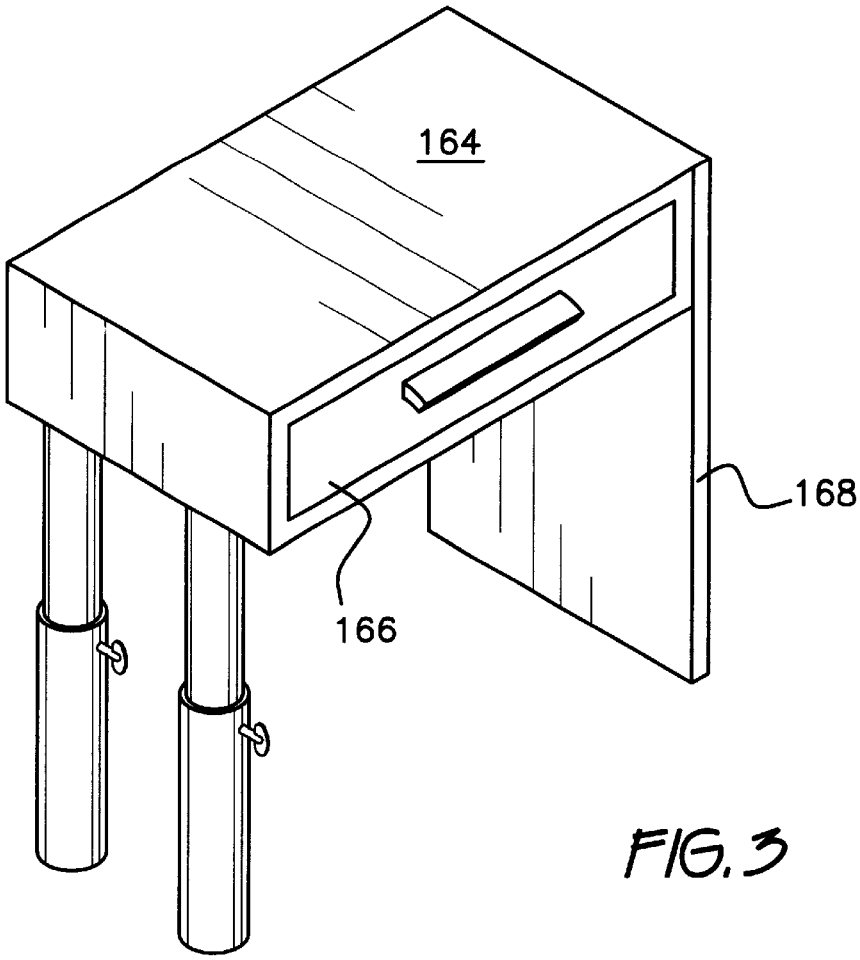
FIG. 3 is a perspective detail view of an embodiment of a portion of the invention.

Returning to FIG. 1, a horizontal tabletop 64 is fixed to base 12. Tabletop 64 has posts 66, 68, 70 (see also FIG. 2) which telescope in the manner of posts 14, 16. As seen in an alternative embodiment in FIG. 3, tabletop 164 has a drawer 166 slidably disposed therewith. Another feature seen in FIG. 3 is a cover panel 168 depending from tabletop 164, for concealing power and communication cables (not shown) which might otherwise be regarded as unsightly. Additional cover panels (not shown) may be provided where desired to extend concealment of power and communication cables.

Figure 4:
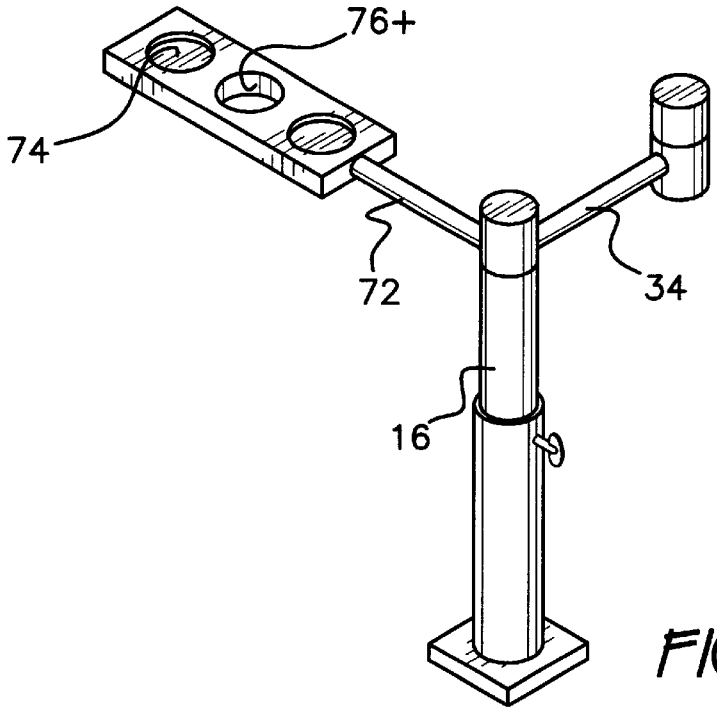
FIG. 4 is a perspective detail view of an embodiment of a portion of the invention.

FIG. 4 shows personal convenience features which may be incorporated into the invention. An arm 72 is affixed to post 16 supports a panel bearing a cup holder 74 and an ashtray holder 76. Arm 72 is pivotally mounted to post 16 in a manner similar to that of swing arm 34, so that cup holder 74 and ashtray holder 76 are movable towards and away from post 16 and chair 2.

Turning now to FIG. 5, a further embodiment of the invention is shown with a panel 218 functionally similar to panel 18 of FIG. 1, which panel provides working surfaces 222, 223 is formed in two separate sections. Each surface 222 or 223 may be independently inclined according to a user's wishes by loosening respective setscrews 250, 251 which secure collars 248, 249, which encircle support arm 244. The panel sections may then be rotated about the longitudinal axis of arm 244, as shown in broken lines in FIG. 6. Setscrews 250, 251 are tightened to secure collars 248, 249 and their associated panel sections in any desired orientation. Either section 222 or 223 of panel 218 is provided with a pencil tray 235 (see FIG. 6) attached thereto. One or more clips 225 (see FIG. 6) are affixed to panel 218, for securing papers (not shown) to the work surface of panel 218.

Optionally, as shown in FIG. 7, a panel 318 having a work surface 322 is provided with a drawer 323 slidably disposed therewith. Panel 318 is in other aspects similar to panel 18 of FIG. 1, having a collar 348 enabling pivotal mounting on a supporting arm 344.

Figure 8:
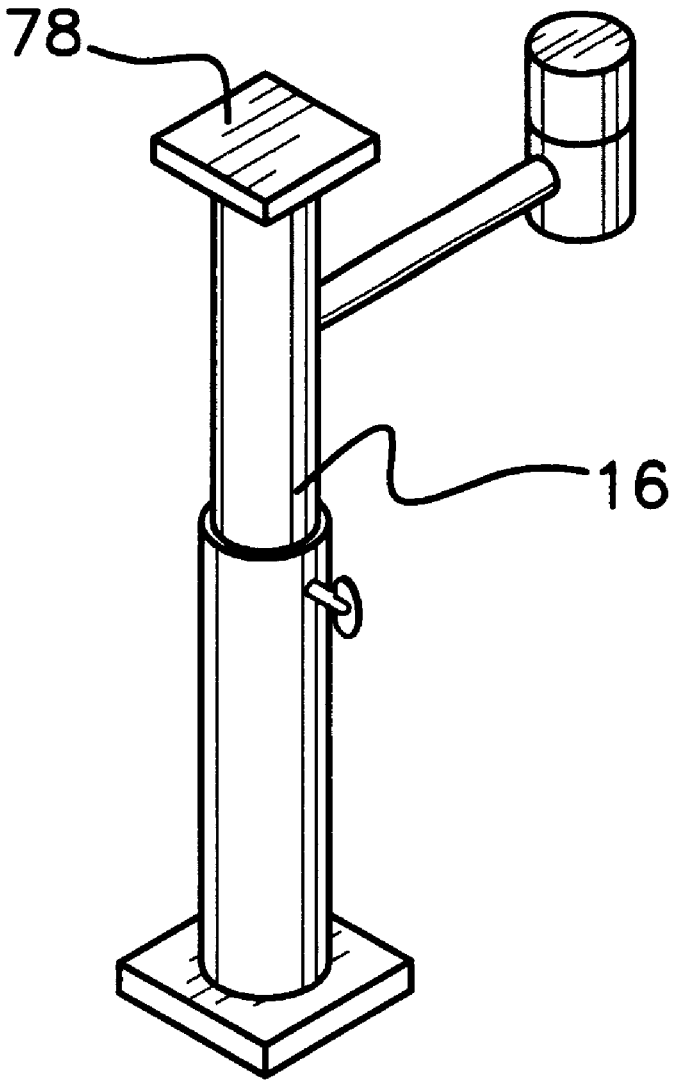
FIG. 8 is a perspective detail view of an embodiment of a portion of the invention.

FIG. 8 shows an optional modification of a post, such as post 16, to include a platform 78 for supporting a speaker atop post 16. Platform 78 may comprise a partially or fully enclosed cabinet, if desired.

Figure 9:
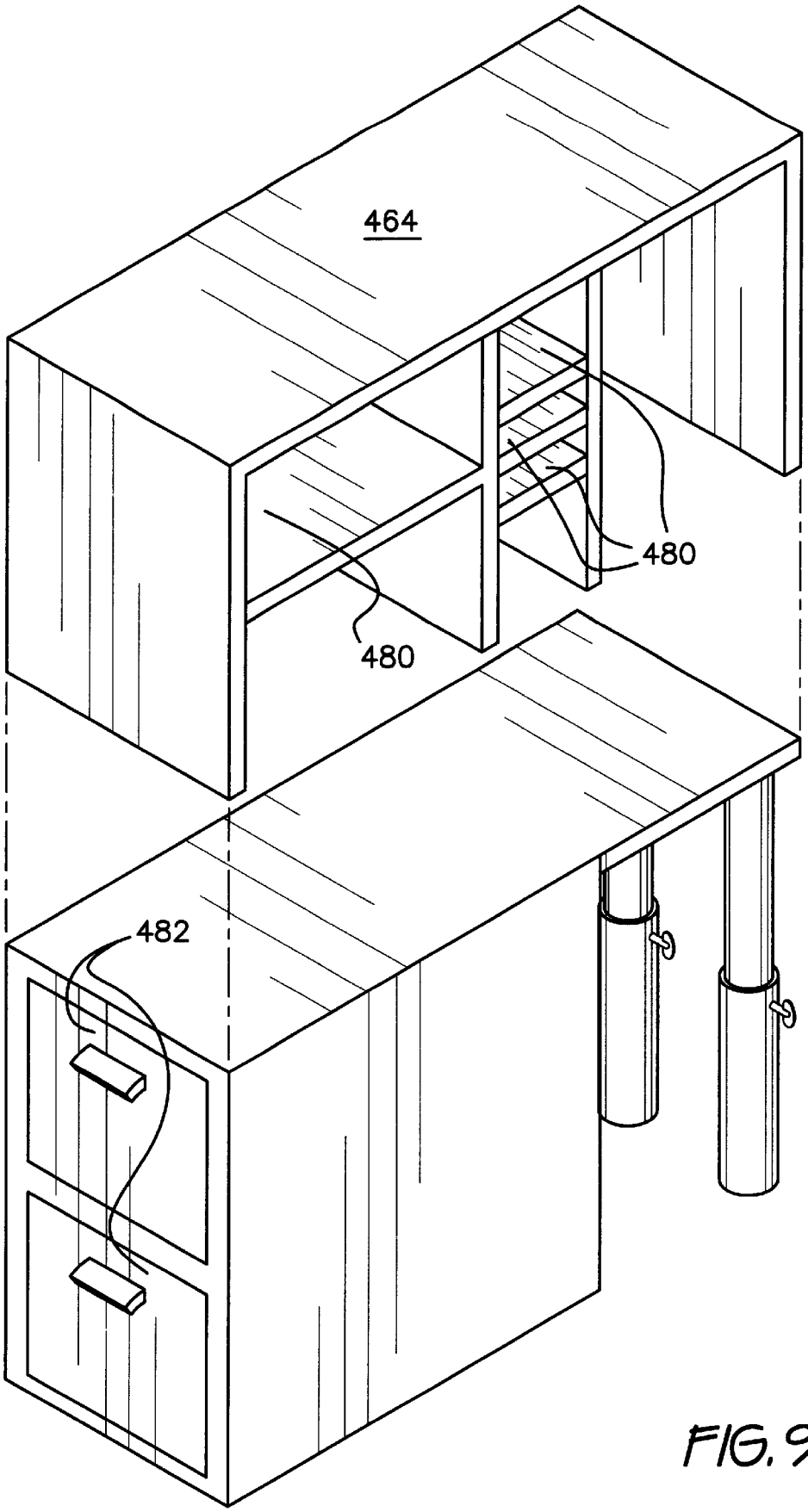
FIG. 9 is a perspective detail view of an embodiment of a portion of the invention.

Additional storage is optionally provided, as shown in FIG. 9. Storage shelves 480 may be provided below or otherwise in close proximity to tabletop 464, if desired. A filing cabinet 482 may be attached to base 412 and located in close proximity to tabletop 464.

Figure 10:
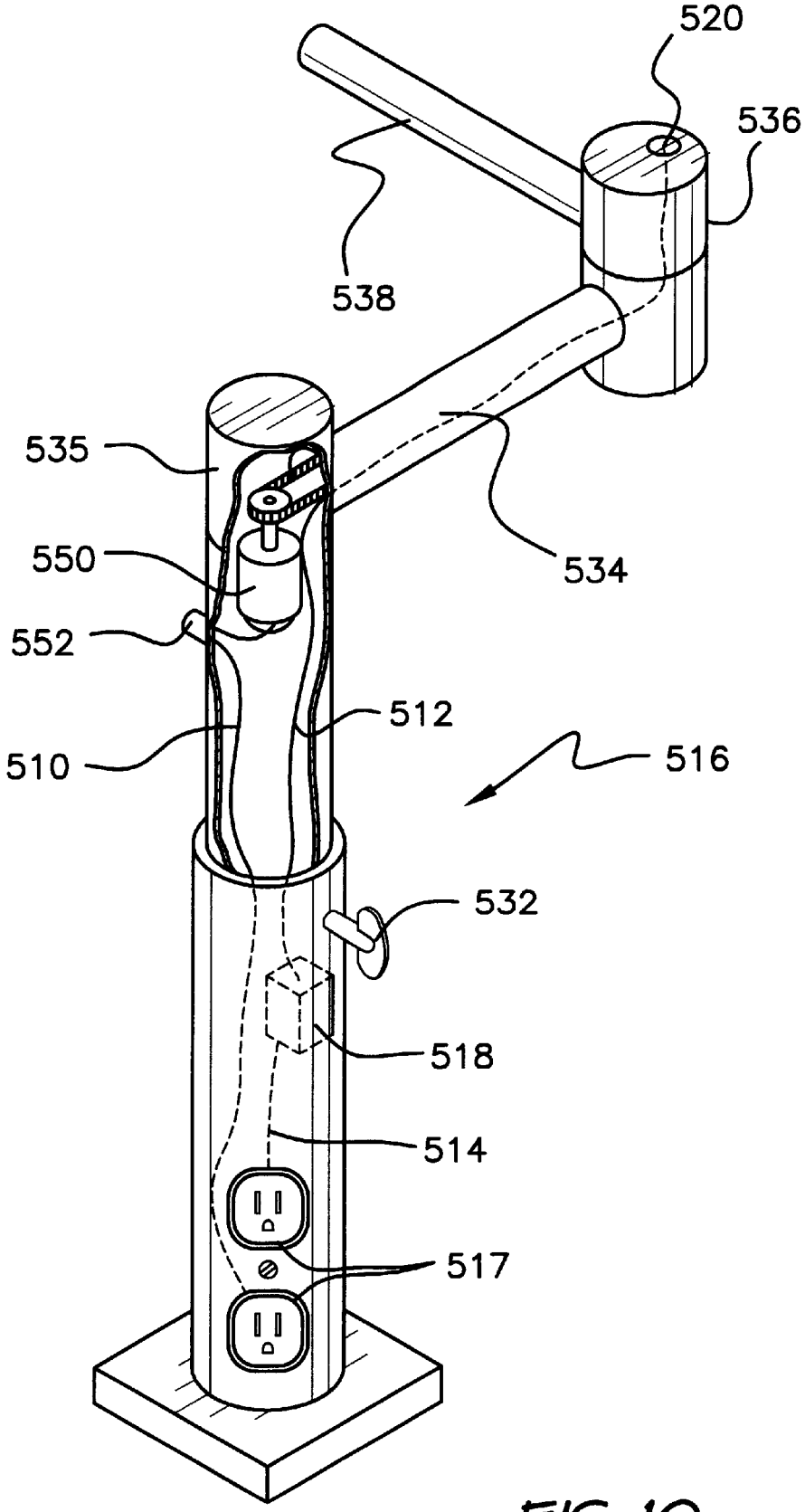
FIG. 10 is a perspective partially broken away to show internal detail view of a powered embodiment of a portion of the invention.

Referring now to FIG. 10, post 516 is modified to include power cables 510, 512, 514 contained within. An exposed power receptacle 517 is connected to power cables 510, 514. A power supply 518, such as an AC-to-DC converter is connected to cable 512, which extends from the power supply 517. Cable 512 extends to an exposed power jack 520 exposed at the top of socket 536.

Motorized adjustment of the position of the working surface (not shown) associated with post 516 is provided for the benefit of the handicapped. A motor 550 is connected to power cable 510 through an external switch 552. A mechanical linkage, such as sprocket and belt assembly 554 is drivably connected to motor 550. The linkage rotates a pin (not shown) which in turn supports and rotates socket 536. The linkage may be extended to rotate a socket (not shown) located at the distal terminus of arm 538. Operation of motor 550 thus adjusts proximity of the work surfaces relative to post 516 such that the user need not extend his or her body unduly and be obliged to grasp and manipulate arm 534 or 538 to adjust position of the working surface relative to post 516 and hence to the chair.

The present invention is susceptible to variations and modifications which may be introduced thereto without departing from the inventive concept. For example, locations of the various amenities may be modified from the examples shown. Any of the novel features may be incorporated into any embodiment and combined with other features. Spanning member 60 of base 12 may be omitted in favor of modifying sections 54, 56 to provide structure formerly provided by member 60.

It is to be understood that the present invention is not limited to the embodiments described above, but encompasses any and all embodiments within the scope of the following claims.

I claim:

1. A support structure in combination with a personal computer system for supporting a computer and related peripherals in proximity to a chair, comprising:

a) a substantially flat base having a first base portion slidably affixed to a second base portion, said second portion being movable with respect to said first base portion;

b) at least one post affixed to each of said first base portion and said second base portion and extending substantially vertically therefrom;

c) at least one work surface movably affixed to each of said at least one post, each of said work surfaces being adjustable in at least a vertical plane and a horizontal plane, at least one of said work surfaces being adjustable so as to vary the proximity thereof to the post to which said at least one work surface is affixed.

2. The support structure in combination with a personal computer system for supporting a computer and related peripherals in proximity to a chair as recited in claim 1, wherein at least one of said work surfaces is tiltably adjustable with respect to said horizontal plane.

3. The support structure in combination with a personal computer system for supporting a computer and related peripherals in proximity to a chair as recited in claim 1, wherein said first base portion and said second base portion are adjustable horizontally so as to vary a space between said at least one post affixed to said first base portion and said at least one post affixed to said second base portion.

4. The support structure in combination with a personal computer system for supporting a computer and related peripherals in proximity to a chair as recited in claim 3, wherein said space is adapted to receive a chair and said space may be varied to accommodate chairs of different widths.

5. The support structure in combination with a personal computer system for supporting a computer and related peripherals in proximity to a chair as recited in claim 1, wherein at least one of said work surfaces is affixed to a respective one of said at least one post by attachment means intermediate said work surface and said at least one post.

6. The support structure in combination with a personal computer system for supporting a computer and related peripherals in proximity to a chair as recited in claim 5, wherein said attachment means intermediate said work surface and said at least one post comprises at least one swing arm.

7. The support structure in combination with a personal computer system for supporting a computer and related peripherals in proximity to a chair as recited in claim 1, wherein at least one of said work surfaces comprises a drawer proximate said work surface.

8. The support structure in combination with a personal computer system for supporting a computer and related peripherals in proximity to a chair as recited in claim 1, wherein at least one of said work surfaces comprises means for performing at least one specialized function.

9. The support structure in combination with a personal computer system for supporting a computer and related peripherals in proximity to a chair as recited in claim 8, wherein said at least one specialized function comprises one from the group: supporting a speaker, supporting and retaining a cup, supporting an ash tray, supporting a pencil tray, supporting at least one sheet of paper using a clip.

10. The support structure in combination with a personal computer system for supporting a computer and related peripherals in proximity to a chair as recited in claim 1, wherein said at least one of said at least one work surfaces comprises a substantially horizontal tabletop.

11. The support structure in combination with a personal computer system for supporting a computer and related peripherals in proximity to a chair as recited in claim 10, wherein said tabletop comprises a drawer.

12. The support structure in combination with a personal computer system for supporting a computer and related peripherals in proximity to a chair as recited in claim 10, wherein said tabletop comprises a cover panel depending from said tabletop, for concealing power and communication cables.

13. The support structure in combination with a personal computer system for supporting a computer and related peripherals in proximity to a chair as recited in claim 1, further comprising:

d) at least one power cable disposed within at least one of said posts and adapted to carry electrical power from a power source external to said computer workstation to at least one electrical outlet disposed within said at least one of said posts.

14. The support structure in combination with a personal computer system for supporting a computer and related peripherals in proximity to a chair as recited in claim 1, further comprising:

d) mechanical actuation means for moving at least one of said work surfaces relative to said at least one of said posts to which said work surface is affixed.

15. The support structure in combination with a personal computer system for supporting a computer and related peripherals in proximity to a chair as recited in claim 14, wherein said mechanical actuation means comprises:

i) an electric motor operatively connected to a source of electrical power;

ii) a mechanical linkage operatively connected to said electric motor and to said at least one work surface;

iii) switch means intermediate said electric motor and said source of electrical power for selectively controlling the flow of electrical power to said motor; whereby when power is selectively applied to said electric motor, said work surface may be moved by said mechanical linkage connected to said motor.

* * * * *